US010661151B2

(12) United States Patent
Strand

(10) Patent No.: US 10,661,151 B2
(45) Date of Patent: May 26, 2020

(54) LATERALLY-SLIDING BOARD WITH BIFURCATED TRUCKS

(71) Applicant: Steen Strand, Santa Monica, CA (US)

(72) Inventor: Steen Strand, Santa Monica, CA (US)

( * ) Notice: Subject to any disclaimer, the term of this patent is extended or adjusted under 35 U.S.C. 154(b) by 0 days.

(21) Appl. No.: 16/404,229

(22) Filed: May 6, 2019

(65) Prior Publication Data

US 2019/0255422 A1 Aug. 22, 2019

Related U.S. Application Data

(63) Continuation of application No. 15/852,300, filed on Dec. 22, 2017, now Pat. No. 10,322,332.

(60) Provisional application No. 62/441,050, filed on Dec. 30, 2016.

(51) Int. Cl.

| | |
|---|---|
| ***A63C 17/04*** | (2006.01) |
| ***A63C 17/00*** | (2006.01) |
| ***A63C 17/01*** | (2006.01) |

(52) U.S. Cl.

CPC ..... *A63C 17/0033* (2013.01); *A63C 17/004* (2013.01); *A63C 17/006* (2013.01); *A63C 17/0046* (2013.01); *A63C 17/0093* (2013.01); *A63C 17/012* (2013.01); *A63C 17/014* (2013.01); *A63C 17/015* (2013.01); *A63C 17/017* (2013.01)

(58) Field of Classification Search

CPC ..... A63C 17/0033; A63C 17/004; A63C 17/0046; A63C 17/006; A63C 17/0093; A63C 17/012; A63C 17/014; A63C 17/015; A63C 17/017

USPC ..... 280/87.042

See application file for complete search history.

(56) References Cited

U.S. PATENT DOCUMENTS

| | | | |
|---|---|---|---|
| 3,399,904 | A | 9/1968 | Schinke |
| 4,140,326 | A | 1/1979 | Huber |

(Continued)

FOREIGN PATENT DOCUMENTS

| | | | |
|---|---|---|---|
| WO | 03033089 | A1 | 4/2003 |
| WO | 2012113011 | A1 | 8/2012 |
| WO | 2015198360 | A1 | 12/2015 |

OTHER PUBLICATIONS

Patent Cooperation Treaty "Notification of Transmittal of the International Search Report and the Written Opinion of the International Searching Authority"; International Application No. PCT/US2017/068436; Applicant Steen Strand; dated Apr. 3, 2018.

*Primary Examiner* — John D Walters
(74) *Attorney, Agent, or Firm* — Martensen IP

(57) ABSTRACT

A bifurcated truck in a laterally-sliding board wheel assembly enables the "freeboard" to seamlessly transition from "carving"—as associated with a traditional skateboard—to new omnidirectional motions, in which the board can easy travel forward, backwards, sideways or in any other directional combination. The wheel assembly of this invention employs a bifurcated truck system having two independent suspension arms, both operating independently from one another and from the board's castering wheels. The wheel assemblies are mirrored at each longitudinal end of the board, resulting in the board's ability to carve, slide or skid—and easily transition back and forth among each of these modes—providing the rider a sense of stability and freedom commonly associated only with snowboarding.

15 Claims, 11 Drawing Sheets

(56) References Cited

U.S. PATENT DOCUMENTS

| | | | | | |
|---|---|---|---|---|---|
| 5,833,252 | A * | 11/1998 | Strand | A63C 17/0033 | 280/87.042 |
| 5,855,385 | A | 1/1999 | Hambsch | | |
| 5,924,710 | A * | 7/1999 | de Courcey Milne | A63C 17/0046 | 280/87.042 |
| 5,997,018 | A * | 12/1999 | Lee | A63C 17/046 | 280/11.28 |
| 6,299,186 | B1 * | 10/2001 | Kao | B62K 3/002 | 280/11.28 |
| 6,419,248 | B1 | 7/2002 | Kay | | |
| 6,536,788 | B1 | 3/2003 | Kuncz et al. | | |
| 7,213,823 | B1 | 5/2007 | Vujtech | | |
| 8,186,694 | B2 | 5/2012 | Nelson et al. | | |
| 8,608,185 | B2 * | 12/2013 | Bermal | A63C 17/012 | 280/87.042 |
| 8,720,916 | B2 | 5/2014 | Bermal | | |
| 8,807,577 | B2 | 8/2014 | Lai | | |
| 8,910,958 | B2 | 12/2014 | Smith | | |
| 9,138,633 | B1 | 9/2015 | Marusiak et al. | | |
| 9,539,489 | B2 * | 1/2017 | Burns | A63C 17/045 | |
| 2009/0206571 | A1 | 8/2009 | Francom et al. | | |
| 2012/0104708 | A1 | 5/2012 | Cristiano | | |
| 2012/0126523 | A1 | 5/2012 | Langer | | |
| 2016/0175692 | A1 | 6/2016 | Burns et al. | | |
| 2016/0206949 | A1 * | 7/2016 | Murphy | A63C 17/013 | |
| 2017/0158270 | A1 | 6/2017 | Meager | | |
| 2017/0165560 | A1 | 6/2017 | Aders | | |

* cited by examiner

LATERALLY-SLIDING BOARD WITH BIFURCATED TRUCKS

RELATED APPLICATION

The present application relates to and claims the benefit of priority to U.S. patent application Ser. No. 15/852,300 filed 22 Dec. 2017 and Provisional Patent Application No. 62/441,050 filed 30 Dec. 2016 both of which are hereby incorporated by reference in their entirety for all purposes as if fully set forth herein.

STATEMENT REGARDING FEDERALLY-SPONSORED RESEARCH OR DEVELOPMENT

This invention is not federally-sponsored.

BACKGROUND OF THE INVENTION

Field of the Invention

Embodiments of the present invention relate, in general, to sporting equipment and more particularly to a laterally-sliding skateboard truck assembly.

Relevant Background

The modern skateboard comprises several basic components, including a riding surface (a deck or board), usually made of an elongated piece of wood, fiberglass or some other sturdy, resilient and flexible material; four wheels, having some sort of ball-bearing arrangement upon which the deck and rider are transported; and two skateboard "trucks", wherein the trucks are the steering mechanisms or devices by which the wheels are connected to the deck. Generally, the trucks are attached to the deck in a mirror-image manner, such that as a user leans to one side of the skateboard, the forces applied by the user cause each truck to simultaneously steer opposite one another. For example, as the rider leans left, the front truck ("front" being the general direction of motion) turns left while the rear truck turns right, forming a leftward arcing path along which the rider travels. While located in a fairly unobtrusive location on the underside of the deck, the trucks on which the wheels are suspended are very important, as the trucks determine how the skater controls the skateboard.

In modern skateboards, the truck includes a base plate, or mounting plate, which is used to screw or bolt the truck to the bottom of the deck; a bolt, which attaches a wheel-mounting axle to the base plate; and an upward-projecting, wheel-mounting axle. The axle suspends the skateboard wheels on either side of a kingpin.

The turning ability of the skateboard depends on the design and adjustments made to the kingpin, as the wheels of the skateboard traditionally pivot around or in close proximity to the kingpin. The kingpin is generally threaded through an oversized hole lined with compressible and resilient bushings, often made of plastic components such as urethane, whereby tightening the kingpin makes it more difficult to flex the axle, and therefore more difficult to turn the skateboard (tightening the kingpin also generally tends to make the skateboard more stable, so there is an inherent trade-off between a user's desire for skateboard maneuverability and stability at high speeds).

As the user leans from side to side, the bolt presses against the bushings, enabling turning and at the same time compressing against the bushings, such that further leaning becomes more and more difficult for the user because of the force of the bushings. The skateboard user steers the skateboard by leaning from one side to another, thereby applying pressure to the truck, such that the truck pivots around the kingpin so that on the front wheels, the outer wheel moves forward while the inside wheel moves aft; on the rear wheels, however, the outer wheel moves aft and the inner wheel moves forward, the resultant forces causing the two sets of wheels no longer to be in alignment. Rather, the wheel sets describe an arc through which the skateboard now travels.

Snowboarding was initially developed as a way to blend surfing and skiing, just as skateboarding was developed as a blend of surfing and skating. Skateboarders appreciated the lateral movement possible in snowboarding and skiing and began to try to obtain similar movement on their skateboards. Much of the popularity of snowboarding rests in its seductive freedom of movement. While these movements result from complex interactions between the board, rider and snow conditions, at least two general characteristics can be readily identified.

First, a snowboarder can turn by leaning his or her weight towards the intended direction of travel. The effect results from the presence of "sidecut" (that is, the concave arc segment of the board's midsection) and flex of the board design. As the board leans onto its edge, it turns along an arc formed by the board's edge; the more deeply concave the edge of the board, the smaller the circle traced by the tighter arc. The radius of this circle is known as the "sidecut radius". If this type of turn is executed cleanly—that is, with little-to-no lateral slippage (also known as "skidding")—it is referred to as "carving". In addition to shortening the sidecut radius, the rider can also control the severity of the turn radius by varying the degree of the lean.

Skateboarders have long replicated this type of carving behavior through the mechanical design of the skateboard trucks. Prior art truck designs turn the skateboard through gentle or severe turns, depending on the amount of lean, much like a snowboard.

Another motion characteristic of a snowboard is its ability either to slide or skid. "Sliding" occurs when the board moves along its longitudinal axis, while lateral motion is typically referred to as "skidding"—as when a car skids while attempting to turn on a slick surface. By adjusting the rider's weight on the board, the board can skid forward, backwards or sideways in the direction of travel. This type of lateral motion varies in inverse proportion to the functioning of the board's edges to carve cleanly through the snow (as opposed to relaxing their "grip", resulting in "skidding"), enabling the rider to experience full omnidirectional motion.

These numerous similarities between snowboarding and skateboarding have led each sports industry to attempt to improve its products by creating or redesigning them to include features found to be useful in the other sport. One of the most significant modifications to the skateboarding industry has been the attempt to redesign a skateboard configuration to include one or more features prevalent in snowboarding, to include the introduction of lateral motion for increased maneuverability and speed control, as well as the ability to perform tricks, such as a 360-degree spin.

A laterally-sliding board, also known as a "Freeboard", is a specialist skateboard designed to closely emulate the behavior of a snowboard. Freeboards were initially developed to allow snowboarders to transition to skateboarding (as an off-season sport), without the need to adapt to a smaller deck and narrower wheelbase.

A freeboard typically has 6 wheels: Four normal, longboard-style wheels at each corner, and two center wheels. The center wheels are often spring-biased but are allowed to caster in all directions. The ability of the wheels on the center axis to freely turn in all directions enables the board to "slide" laterally, provided that neither of the two downhill, corner wheels contact the ground. This mimics the traditional "side-to-side" motion of snowboard riding. By exerting pressure on the corner wheels, the rider is able to control the board.

While these boards were an alternative to the traditional skateboard, permitting "drifting" or "sliding", the suspension system for the wheels, that is, the "truck", was a heavy, unarticulated, solid piece of metal, with one or more casters placed at the center of the truck, with the outer wheels mounted on a single "hangar" (axle assembly), as well as one or more casters placed on the center side of the truck. The hangar and caster(s) were all affixed to a single truck, with one truck on either end of the board. Thus, when a rider wanted to slide the board, the wheels on the uphill edge of the board would rotate closer to the deck at the same angle as the wheels on the downhill edge of the board would rotate closer to the ground. The precariousness of this arrangement limits the clearance distance of the downhill wheels with the ground, making it dangerous for riders: If the downhill wheels contact the ground, they can "catch an edge" (analogizing to the similar term in snowboarding) severely decelerating or stopping the skateboard, and throwing the rider from the skateboard. This is similar to a snowboarder catching an edge, albeit on concrete rather than snow.

When a rider wanted to slide the board, once the rider overcame the initial inertia and forced the castering wheels to turn enough to lift the downhill wheel off the ground and force the castering wheels to turn in the direction of the "drift", or "slide", only the castering and uphill wheels remained on the ground. The downhill, non-castering wheels remained dangerously close to the ground: Even a minor irregularity in a street's surface could "catch" one or more downhill wheels and send the skateboarder flying off the skateboard and onto the pavement. The precariousness of this arrangement can be seen not only in videos of riders on these types of boards—the riders shown delicately trying to balance the sliding motion with two of the six wheels on the skateboard only a few millimeters above the rough pavement—but also in the fact most of these boards are sold with bindings that enhance stability by keeping the rider's feet firmly attached to the skateboard.

A biased caster was developed for more positive control over the laterally-sliding rollerboard. The center caster was connected to a spring and biased through spring-loading to align with the longitudinal board axis, and the rider had to overcome the spring's threshold force, or moment, so the caster wheel would caster to move the board laterally. Snowboards have a natural tendency to go straight and biased casters were designed to simulate that tendency.

More recently, a cam system was introduced, in which the position of the caster wheel was displaced laterally from the board's longitudinal centerline as the board was placed into a slip or skid. Cam linkage between the side wheels and the center wheel moved the center wheel laterally as a lateral slide was initiated and returned it to a neutral, longitudinally-centered position when the board was traveling along the longitudinal board axis.

A long-felt need exists for a safer, laterally-sliding board suspension system that allows for smooth, controlled slides, drifts and stops. This system would allow the uphill wheels and the center castering wheel to remain on the ground while the downhill wheels are lifted off the ground to a clearance height sufficient to avoid the pavement or surface irregularities. Moreover, a strong need remains for a wheel assembly that is stable for all skill levels, so that even inexperienced riders can learn techniques associated with drifts, slides and stops—but at their own pace and in an environment (and speed) that enhances rider safety. A need also exists to allow riders to customize their boards to suit their riding preferences for the position and characteristics of the center wheel and fixed-wheel configurations. Lastly, freeboards of the prior art operate in a "rocker" fashion, in which the board, when resting on the center wheel, must tip to one side or the other for the fixed wheels on that side of the board to contact the pavement. This functioning is necessary for prior-art boards to "slide" laterally, but is unlike that of a snowboard, which has no rocker-like operation, and the rickety, spasmodically-alternating, left-lean-right-lean, rocker-like motion of these boards is very disconcerting to novice riders. These and other deficiencies of the prior-art designs are addressed by one or more embodiments of the present invention.

Additional advantages and novel features of this invention shall be set forth in part in the description that follows, and will become apparent to those skilled in the art upon examination of the following specification or else may be learned by the practice of the invention. The advantages of the invention may be realized and attained by means of the instrumentalities, combinations, compositions and methods particularly pointed out in the appended claims.

SUMMARY OF THE INVENTION

A laterally-sliding board is presented that, according to one embodiment of the present invention includes a board or deck with a center wheel coupled to the underside of the board, wherein the center wheel casters. The laterally-sliding board further includes a first suspension arm having a first rotatable wheel, wherein the first suspension arm is hingedly coupled to the underside of the board, having a first axis of rotation and a first spring interposed between the board and the first suspension arm, wherein the first spring produces a first force biasing rotation of the first suspension arm away from the underside of the board.

The laterally-sliding board of the present invention further includes a second suspension arm having a second rotatable wheel, wherein the second suspension arm is also hingedly coupled to the underside of the board, having second axis of rotation and, like the first suspension arm, a second spring is interposed between the board and the second suspension arm, wherein the second spring produces a second force biasing rotation of the second suspension arm away from the board. The board is designed so that rotation by the first suspension arm about the first axis of rotation is independent of rotation by the second suspension arm about the second axis of rotation and wherein rotation of each of the first suspension arm and the second suspension arm is independent of the center wheel.

Additional features of the laterally-sliding board include the fact that the center wheel casters about a vertical axis orthogonal to the board, as well as the fact the board defines a planar surface having a central longitudinal axis and a lateral axis, in which the center wheel is coupled to the board along the longitudinal axis.

In one embodiment of the invention the first axis of rotation and the second axis of rotation are coaxial while in another embodiment the first axis of rotation and the second axis of rotation are parallel.

With respect to the springs, in one embodiment of the invention the first force associated with the first spring is a variable force and this variable force is based on displacement of the spring.

Another feature of the invention is that the rotation by the first suspension arm about the first axis of rotation defines a first plane of rotation and wherein rotation by the second suspension arm about the second axis of rotation defines a second plane of rotation, and wherein the first plane of rotation and the second plane of rotation are coplanar.

Another feature of the present invention is a cam or a similar means for limiting travel of the first suspension arm about the first axis of rotation away from the underside of the board.

Yet another feature of the present invention is that each of the center wheels, the first rotatable wheel and the second rotatable wheel include a ground contact surface configured to contact a ground surface and wherein each ground contact surface is coplanar when the underside of the board is parallel to the ground surface eliminating rocker motion. This "6 on the floor" feature adds stability and gives newer riders confidence as they master skills necessary to ride the laterally-sliding board of the present invention. Moreover, the present invention is configurable so as to provide a "6 on the floor" configuration or create a more traditional "rocker" configuration.

And while the board of the present invention has been described using a single wheel assembly as an example, the invention can include a third suspension arm having a third rotatable wheel, wherein the third suspension arm is hingedly coupled to the underside of the board having a third axis of rotation. Similarly the invention can include a fourth suspension arm having a fourth rotatable wheel, wherein the fourth suspension arm is hingedly coupled to the underside of the board having fourth axis of rotation and wherein rotation by the fourth suspension arm about the fourth axis of rotation is independent of rotation by the first, second and third suspension arm about the first, second and third axis of rotations, respectively.

In this aspect of the present invention—that is, with the third and fourth suspension arms and wheels—as with the first and second suspension arms, rotation by the third suspension arm about the third axis of rotation defines a third plane of rotation, and rotation by the fourth suspension arm about the fourth axis of rotation defines a fourth plane of rotation, in which the third plane of rotation and the fourth plane of rotation are coplanar. Because each suspension arm is independent, the first plane of rotation and the third plane of rotation are not coplanar and each is independent.

Another aspect of the present invention is the formation of laterally-sliding board by coupling a center wheel to an underside of the board, in which the center wheel casters, and then hingedly coupling a first suspension arm, having a first rotatable wheel, to the underside of the board, wherein the first suspension arm rotates about a first axis of rotation. The formation continues by interposing a first spring between the board and the first suspension arm, and the first spring produces a first force, biasing rotation of the first suspension arm away from the underside of the board, and hingedly coupling a second suspension arm, having a second rotatable wheel, to the underside of the board, wherein the second suspension arm rotates about a second axis of rotation. As with the first suspension arm, the formation of the laterally-sliding board includes interposing a second spring between the board and the second suspension arm, wherein the second spring produces a second force biasing rotation of the second suspension arm away from the board, and wherein rotation by the first suspension arm about the first axis of rotation is independent of rotation by the second suspension arm about the second axis of rotation, and wherein rotation of each of the first suspension arm and the second suspension arm is independent of the center wheel.

Additional features of the present invention include that the first force associated with the first spring is a variable force. As the board defines a planar surface having a central longitudinal axis and a lateral axis, the center wheel is therefore coupled to the board along the longitudinal axis. Formation of the board continues by coupling a second center wheel to the underside of the board, wherein the second center wheel freely casters about a second vertical axis which is orthogonal to the board, and wherein the second center wheel is coupled to the board along the central longitudinal axis.

Another aspect of the invention is configuring the first suspension arm with a cam or similar means to limit travel of the first suspension arm about the first axis of rotation away from the underside of the board.

In the laterally-sliding board of the present invention, in one embodiment the first axis of rotation and the second axis of rotation are coaxial while in another embodiment the first axis of rotation and the second axis of rotation are parallel. In yet other embodiments the first axis of rotation and the second axis of rotation are not parallel and equally diverse from the longitudinal axis of the board.

The features and advantages described in this disclosure and in the following detailed description are not all-inclusive. Many additional features and advantages will be apparent to one of ordinary skill in the relevant art in view of the drawings, specification and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1:
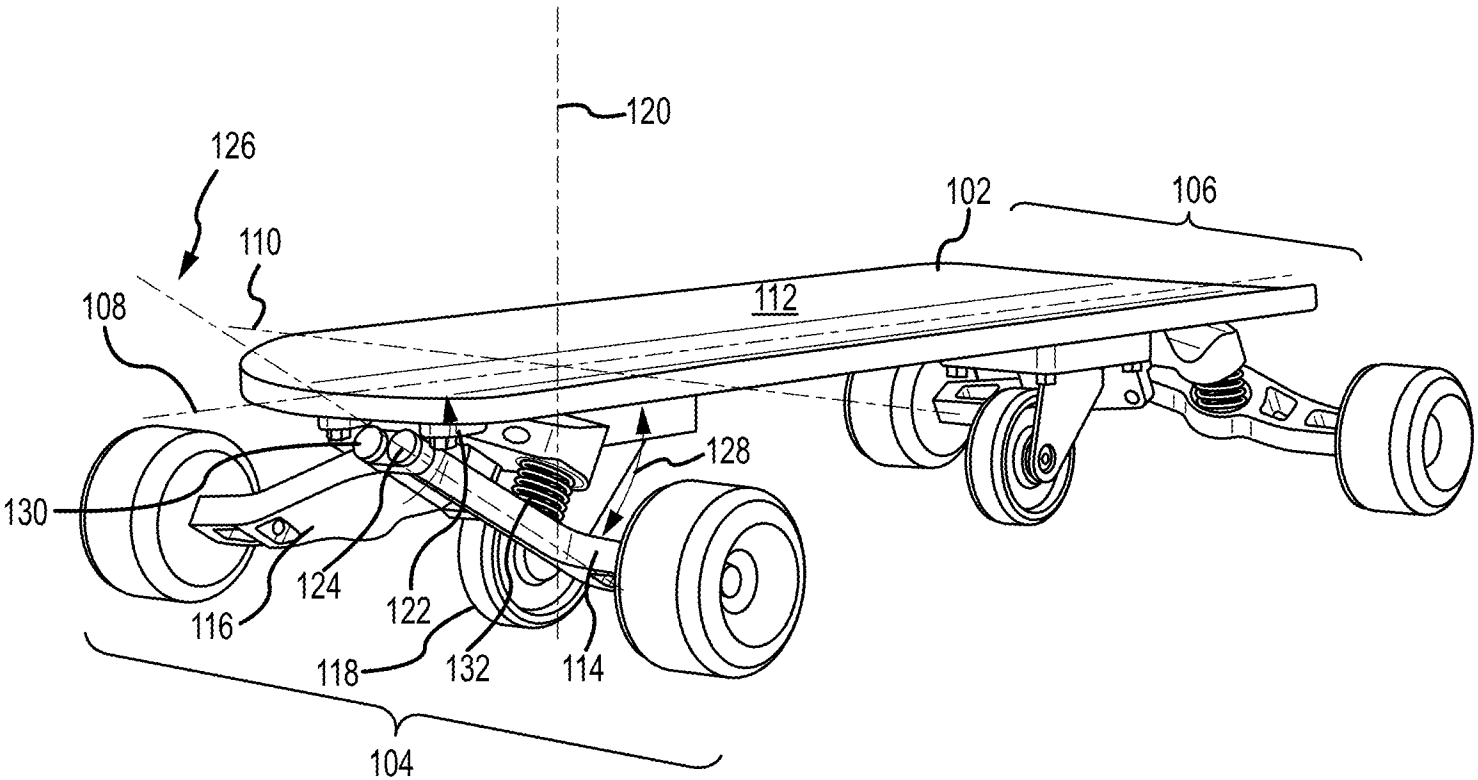
FIG. 1 shows a front left perspective view of a laterally-sliding board with bifurcated trucks, according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

A bifurcated truck in a laterally-sliding board wheel assembly enables the board to seamlessly transition from carving, as associated with traditional skateboard motion, to an omnidirectional mode in which the board can easily maneuver forward, backwards, sideways or in any combination of these motions. The wheel assembly of the present invention employs a bifurcated truck system having two independent suspension arms that operate independently of each other and of the center, castering wheel. With the wheel assembly mirrored at each longitudinal end of the board, the resulting laterally-sliding board can carve, slide and skid, and it can easily transition among each of these type of maneuvers with the stability and freedom commonly associated with a snowboard.

Embodiments of the present invention are hereafter described in detail, with reference to the accompanying Figures. Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention, as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only, and not for the purpose of limiting the invention as defined by the appended claims and their equivalents.

By the term "substantially" it is meant that the recited characteristic, parameter, or value need not be achieved exactly, but that deviations or variations—including for example, tolerances, measurement error, measurement accuracy limitations and other factors known to those of skill in the art—may occur in amounts that do not preclude the effect the characteristic was intended to provide.

Like numbers refer to like elements throughout. In the Figures, the sizes of certain lines, layers, components, elements or features may be exaggerated for clarity.

The terminology used herein is for the purpose of describing particular embodiments only, and is not intended to be limiting of the invention. As used herein, the singular forms "a", "an" and "the" are intended to include the plural forms as well, unless the context clearly indicates otherwise. Thus, for example, reference to "a component surface" includes reference to one or more of such surfaces.

As used herein, any reference to "one embodiment" or "an embodiment" means that a particular element, feature, structure or characteristic described in connection with the embodiment is included in at least one embodiment. The appearances of the phrase "in one embodiment" in various places in the specification are not necessarily all referring to the same embodiment.

As used herein, the terms "comprises", "comprising", "includes", "including", "has", "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on", "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the Figures. It will be understood that the spatially relative terms are intended to encompass different orientations of a device in use or operation in addition to the orientation depicted in the Figures. For example, if a device in the Figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only, unless specifically indicated otherwise.

Included in the description are flowcharts depicting examples of the methodology which may be used to form a laterally-sliding board with bifurcated trucks. In the following description, it will be understood that each block of the flowchart illustrations, and combinations of blocks in the flowchart illustrations, may be implemented by, in part, computer program instructions. These computer program instructions may be loaded onto a computer or other programmable apparatus to produce a machine such that the instructions that execute on the computer or other programmable apparatus create means for implementing the functions specified in the flowchart block or blocks. The computer program instructions may also be loaded onto a computer or other programmable apparatus to cause a series of operational steps to be performed in the computer or on the other programmable apparatus to produce a computer implemented process such that the instructions that execute on the computer or other programmable apparatus provide steps for implementing the functions specified in the flowchart block or blocks.

Accordingly, blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware, hardware-based computer systems, and similar systems that perform the specified functions or steps, or combinations of special purpose hardware.

Upon reading this disclosure, those of skill in the art will appreciate still additional alternative structural and functional designs for a laterally-sliding board with bifurcated trucks through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

FIG. 1 shows a front left perspective view of a laterally-sliding board with bifurcated trucks, according to one embodiment of the present invention. A deck, or "board" 102, as is it sometimes referred to herein, is coupled atop a front and a rear wheel assembly. The front 104 and rear 106 wheel assembly are, in this embodiment, configured to mirror themselves along a longitudinal axis 108 of the board, equidistant from a lateral axis 110 bisecting the board.

In the instance of the embodiment of the invention shown in FIG. 1, the upper surface 112 of the board presents a slightly concave shape, with a corresponding convex underside or lower surface of the board associated with each wheel assembly. Each of a forward and rear wheel assemblies includes a bifurcated truck having a first suspension arm 114 (also referred to as a hangar) and a second suspension arm 116, and a center wheel 118 that casters. According to one embodiment of the present invention, the center wheel and the bifurcated truck are separate components, albeit configured as a single wheel assembly. In other embodiments, the center wheel and bifurcated truck are integrated into the same mounting fixture.

The laterally-sliding board shown in FIG. 1 is associated with the longitudinal axis 108 that extends along and bisects the board and a lateral axis 110, perpendicular to the longitudinal axis. The lateral axis is substantially parallel with the bifurcated trucks when the board is in a resting or neutral position. For reference, an orthogonal, vertical axis 120 extends out of the top of the board and into the pavement on which the wheels rest.

As mentioned, each truck of each wheel assembly includes two suspension arms. Each suspension arm is hingedly coupled to a mounting bracket 122 via a suspension arm pin 124, defining an axis of rotation 126. The suspension arm rotates about the suspension arm pin, forming a rotation plane. Thus, the first suspension arm 114 is hingedly coupled to the forward wheel assembly mounting bracket 122 via the first suspension arm pin 124. The first suspension arm 114 rotates 128 about a first axis of rotation, forming a first rotation plane. A second suspension arm 116 extends laterally from the board, on the side opposite from the first suspension arm 114, and is hingedly coupled to the mounting bracket 122 via a second suspension arm pin 130, thus defining a second axis of rotation. The second suspension arm rotates about the second suspension pin, forming a second rotation plane.

According to one embodiment of the present invention, the first axis of rotation and the second axis of rotation are parallel. In other embodiments the first and second axis of rotation are collinear. Each axis of rotation lies in a plane parallel to a vertical plane defined by the vertical and longitudinal axes. In the instance shown in FIG. 1, each axis of rotation is offset slightly from the longitudinal axis, albeit each is still within a plane parallel to the vertical plane.

The axis of rotation is further depressed from a plane defined by the lateral and longitudinal axes (i.e., the plane of the surface of the board), toward an "axial point" below the centroid of the board, the axial point being located between the longitudinal limits of the board. The angular depression of each respective axis of rotation tilts the plane of rotation of the suspension arms toward a "planar point" above the centroid, the planar point being located between the longitudinal limits of the board. While in this instance the angle of depression is fixed, in other embodiments the angle of depression, and thus the plane of rotation of each suspension arm, can be adjusted to provide different riding characteristics.

Each suspension arm is, as shown in FIG. 1, coupled to the mounting bracket independent of the other suspension arm, and both suspension arms are independent of the center wheel. Thus, each wheel contact with the surface of the ground is independently determined. As weight is applied to the board and transferred to the wheel assembly, the suspension arms deflect about their respective axes of rotation.

Interposed between each suspension arm and the mounting bracket is a spring 132. As the suspension arms rotate about their respective axis of rotation, the arm compresses the spring, forming a force substantially directed toward the pavement. The force exerted by a spring varies linearly with respect to its extension or compression. Thus as the spring becomes more compressed, the force resisting the compression increases.

In other embodiments of the present invention the spring may be a combination of springs, or a conical spring, that provide a nonlinear force response. In this embodiment, the initial compression is a light damping force that exponentially increases as the rider leans more and more into the turn (and thus increasingly depresses the suspension arms). In other embodiments, these springs can be interchanged to provide users the ability to modify characteristics of the board according to riding conditions or to modify the same board based on different users. The laterally-sliding board of the present invention enables each user to configure the resistance force based on the desired characteristics. A heavy rider or a rider who is aggressive may desire a stiffer response, as provided through a stronger spring implementation, while another rider may seek a more tempered or softer response. The ability to swap out each spring positioned between the mounting bracket and each suspension arm enables users to customize their rides. Moreover, the springs need not be of the same type or tension: The independent nature of each suspension arm provides the user the ability to modify the characteristics of the board so its response to slides and skids is asymmetrical.

FIG. 1 depicts an embodiment of the present invention by which each suspension arm is associated with a spring positioned between the arm and the truck mounting bracket. In another embodiment of the present invention a single spring is orientated between the first and second suspension arm and orientated substantially parallel with the lateral axis when the board and the suspension arms are in a static configuration. In this embodiment as the board leans toward one side the spring depresses against the other suspensions arm, which, by virtue of the limit cam/screw, is static. This single spring design reduces cost and part count yet maintains each suspension arm's independent nature as in normal use only one suspension arm is applying force to the spring at a time. When the rider leans to the left, the left suspension arm moves up against resistance from the spring and the right suspension arm does not move. When the rider leans to the right, the right suspension arm moves up against the resistance of the spring and the left suspension arm does not move. Moreover, if the rider is performing certain freestyle maneuvers the single spring can apply force to both suspension arms simultaneously. In this type of scenario, it is advantageous to lessen the rotation of the suspension arms to prevent wheel scrubbing resulting from the edge wheels being out of axial alignment. Sharing a single spring is useful as it lessens the rotation of a given suspension arm when both are in use simultaneously.

In another embodiment of the present invention a multi-bar suspension design is used for each suspension arm. Using, for example a 4-bar design, this embodiment of the present invention would enable each wheel to maintain flat ground contact throughout the movement art of the suspension arm. As one of reasonable skill in the relevant art will appreciate as a single suspension arm rotates about the axis of rotation the angle at which the wheel makes contact with the ground varies. The wheels, according to one embodiment of the present invention are rotatably coupled to the end of the suspension arm but they are not articulated. In the static configuration of the board, in which all 6 wheels are in contact with the ground and/or the board's travel is aligned with its longitudinal axis, the entirety of the tread or flat surface of the wheel contacts the ground. As the suspension arm rotates, and with it the wheel, a decreasing percentage of the tread surface contacts the ground. In the multi/4-bar design embodiment, the entire tread surface of the wheel remains in contact with the ground throughout the arc of rotation of the suspension arm.

In snowboarding, by convention, the regular stance on the board is a rider foot position with the rider's left foot forward; in contrast, the so-called "goofy" stance is a position with the rider's right foot forward. This foot-position terminology convention is the same for laterally-sliding boards. As with snowboards, the stance can also determine a preference for skidding versus carving. The present invention enables novice and expert riders alike to modify their boards to have differing characteristics from one another.

For example, a novice may want to first learn to skid in a certain direction and by modifying the springs or the spring tension, the performance of the board in one direction may be different from that of another direction. Similarly, an expert may want to modify one side of the board, or the front versus the back, to accomplish tricks or stunts. The versatility of the present invention provides the means by which a novice can learn how to ride the board, while the seasoned professional can set the board up to maximize its performance.

One of reasonable skill in the relevant art will further appreciate that a "spring", as the term is used herein, is indicative a system or device to produce a resultant force. In other embodiments a pneumatic system or an elastomer or the like may be used. The term "spring", as it used herein, is a device which produces a force to drive the suspension arm downward and to absorb/dampen impacts and irregularities in the pavement.

Figure 2A:
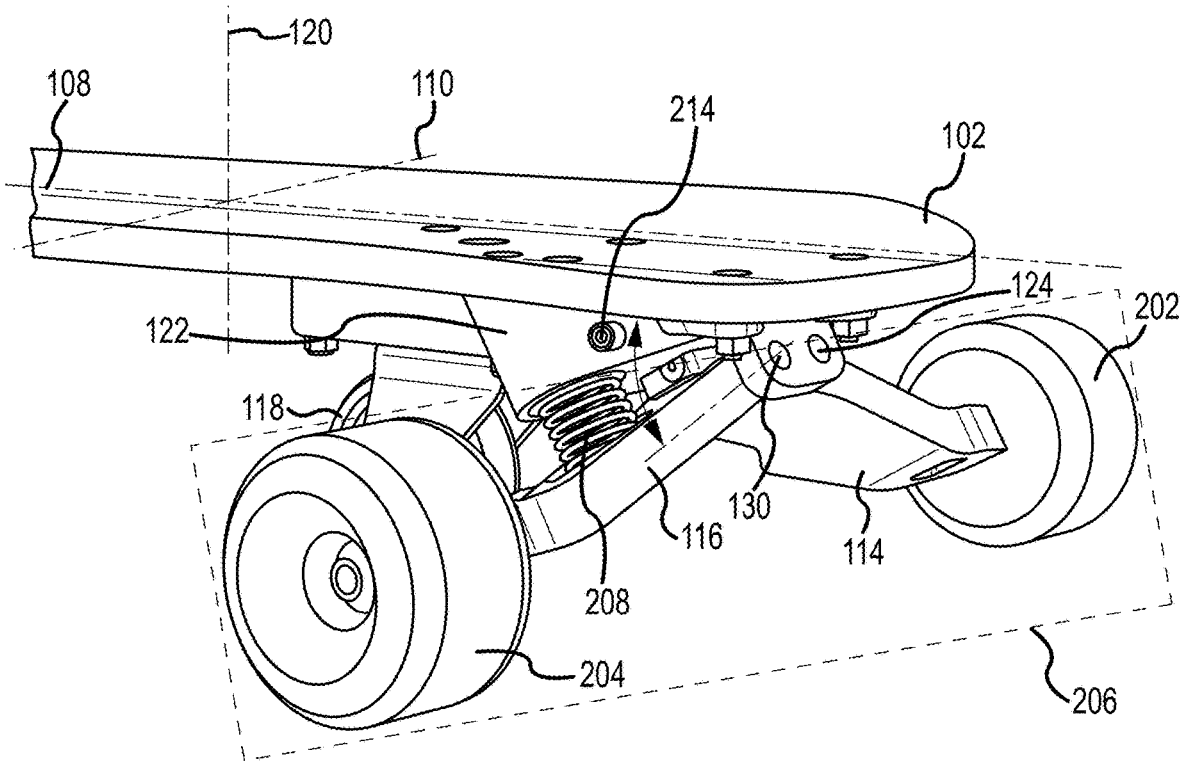
FIG. 2A is a right front perspective view of a front wheel assembly, according to one embodiment of the present invention.
Figure 2B:
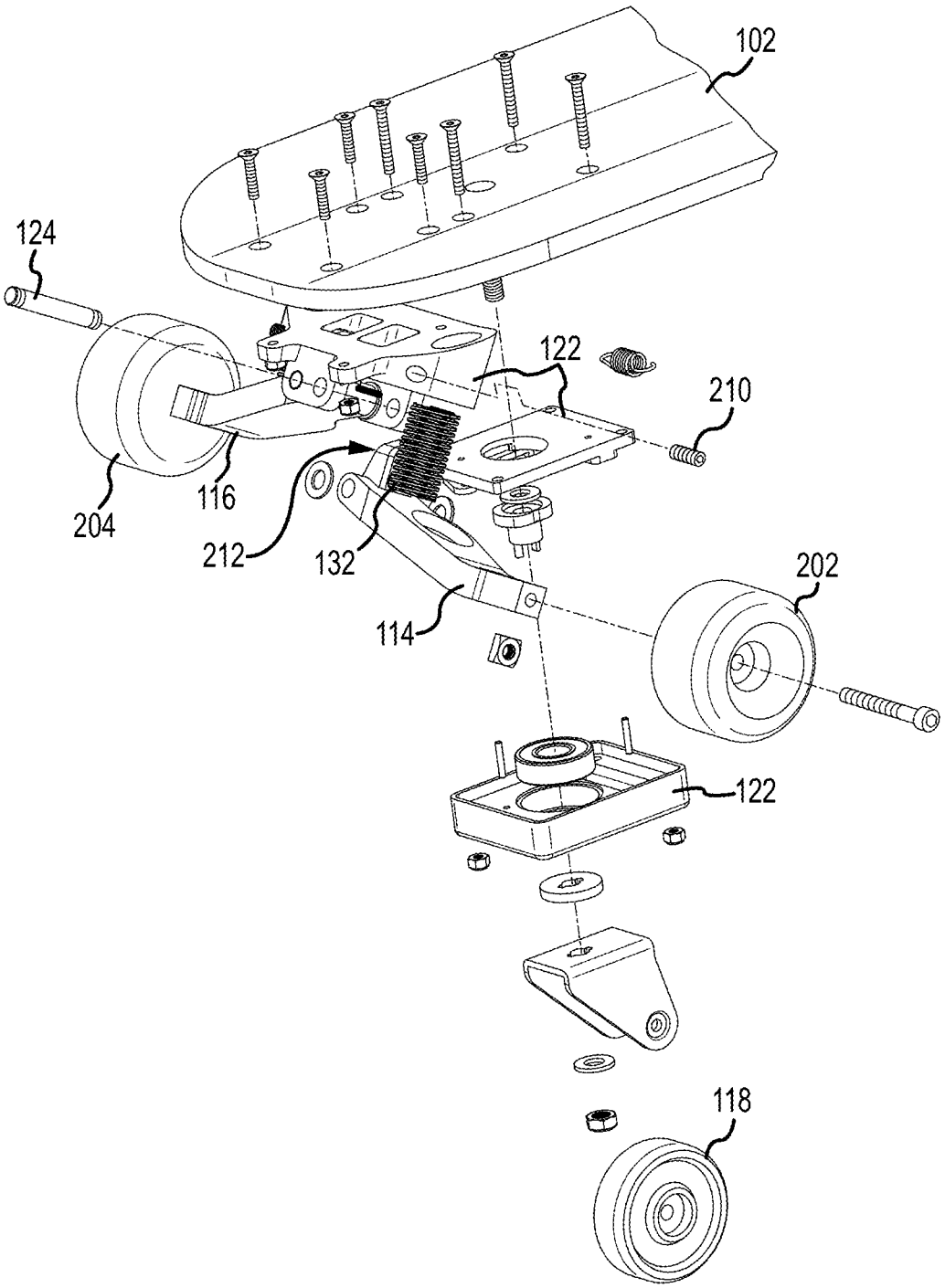
FIG. 2B is an exploded right front perspective view of a front wheel assembly, according to one embodiment of the present invention.

FIG. 2A is a right front perspective view of a front wheel assembly, according to one embodiment of the present invention. FIG. 2B is an exploded view of the same rendering from a front right perspective view. These renderings show a front wheel assembly having a bifurcated truck 206. A first suspension arm 114 includes a wheel 202 that is rotatably coupled to the arm and is configured to interact with a ground surface. A second suspension arm 116 includes a second rotatably coupled wheel 204 forming the other half of the truck. In this instance, the first suspension arm 114 is hingedly coupled to the mounting bracket 122 by a first suspension arm pin 124 and the second suspension arm 116 is hingedly coupled to the mounting bracket 122 by a second, distinct, suspension arm pin 130. In other embodiments, the first and second suspension arms can be hingedly coupled to the mounting bracket by the same pin, yet nonetheless function independently.

A first suspension arm spring (not shown) is interposed between the first suspension arm 114 and the underside 310 of the board 102. In this rendering, the spring interacts with the board at a mounting bracket or base which in turn is affixed to the board. A second suspension arm spring 208 is interposed between the second suspension arm 116 and the board/mounting bracket 122 combination. The configuration of each suspension arm and its associated suspension arm pin enables each suspension arm to rotate about its respective suspension arm pin independently. In other embodiments, a linkage such as an elastic polymer exists between the two suspension arms, to minimize vibration and relative displacement.

Figure 3A:
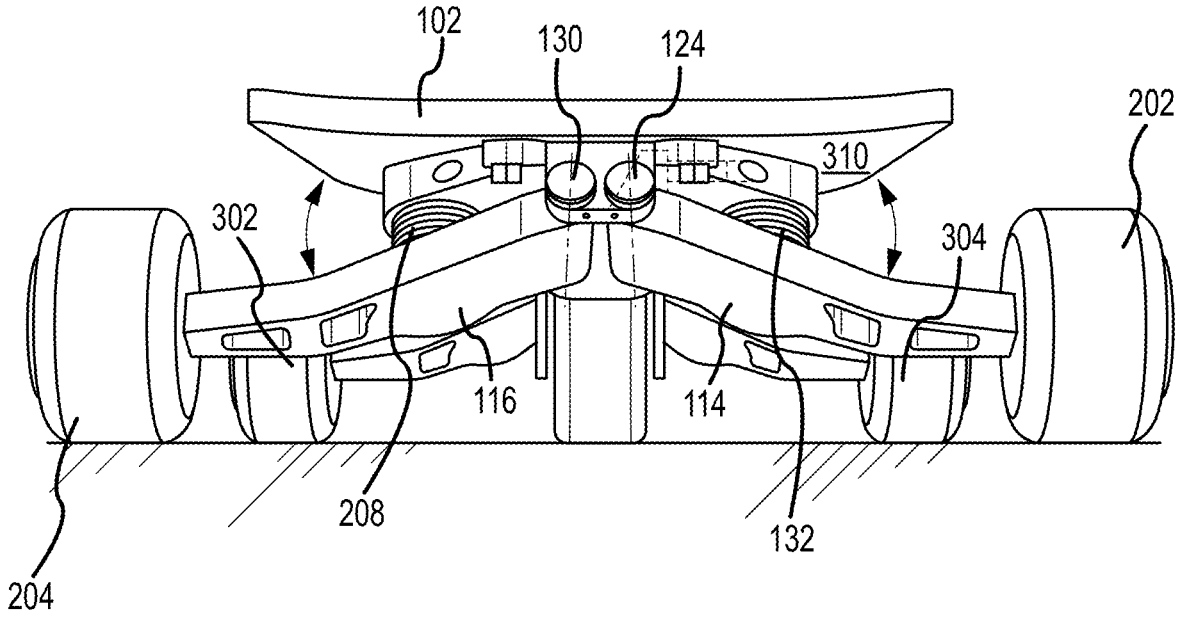
FIG. 3A is a front view of a laterally-sliding board having a bifurcated truck, according to one embodiment of the present invention.
Figure 3B:
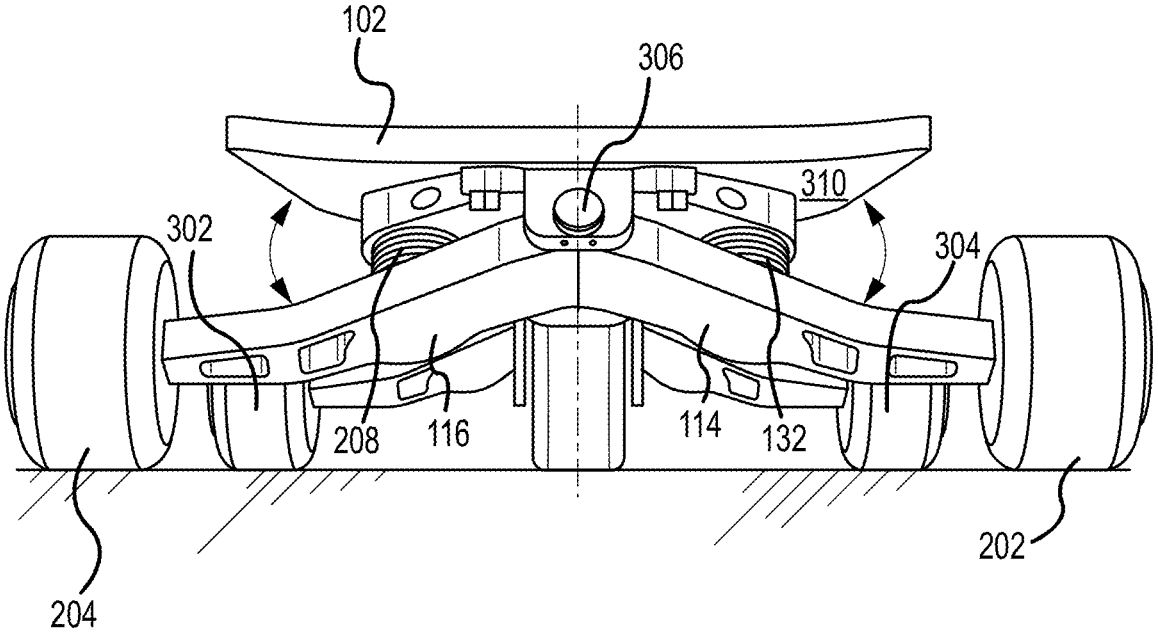
FIG. 3B is a front view of a laterally-sliding board having a bifurcated truck operating on a single axis of rotation, according to one embodiment of the present invention
Figure 4:
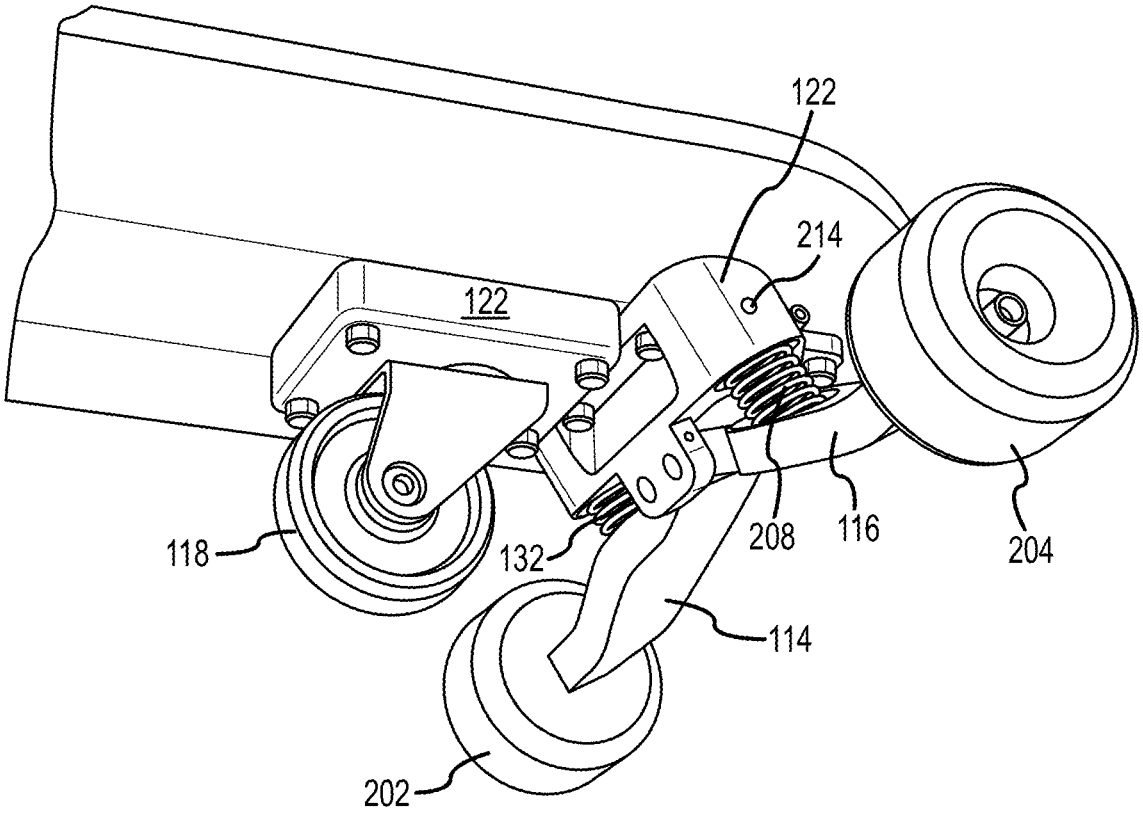
FIG. 4 is a lower right perspective view of a front wheel assemble of a sliding board with a bifurcated truck, according to one embodiment of the present invention.

FIG. 3A is a front view of a laterally-sliding board having a bifurcated truck, according to one embodiment of the present invention. FIG. 3B is a front view of a laterally-sliding board having a bifurcated truck with a single axis of rotation. FIG. 4 presents a lower rear perspective view of the front wheel assembly, the assembly having a bifurcated truck for comparison, providing further understanding of the invention. The front view shown in FIG. 3 of the front wheel assembly illustrates the symmetrical, yet independent nature of the present invention. Note that the side wheels 302, 304 of the board's third and fourth suspension arms (from the second, or rear wheel assembly) are also visible.

Another feature of the present invention, and as illustrated in FIG. 3, is the present invention's lack of rocker. "Rocker" occurs from the unequal displacement of the center wheel from the underside 310 of the board, versus the displacement from the board's underside of each side wheel, which is less than that of the center wheel. The result is that the center wheels are displaced slightly lower than the side wheels. In a traditional board, when the board is in a neutral position, the center wheel is in contact with the ground and each side wheel is raised slightly off the ground. The board therefore "rocks" back and forth, contacting only the two side wheels on a particular side at any one time, based on the position of the rider. Unless perfectly balanced (in which case, only the two center wheels contact the ground and all side wheels are slightly raised off the ground), the board typically rests on the center wheels and two side wheels of one side. The other, opposite, side wheels are slightly elevated off the ground.

This "rocker" phenomenon is unlike anything a snowboard produces. Snowboards smoothly transition from one edge (analogizing, this would be the snowboard's "side wheels") to another, due to the flat, underlying surface of the board and the compliant nature of snow. In contrast, the pavement on which laterally-sliding boards operate is non-compliant, and to assist riders from "catching an edge", the center wheel is displaced slightly lower from the underside of the board than each side wheel. The disadvantage of this configuration, however, is that "rocker" produces a disconcerting feel of tipping that often inhibits novices from confidently riding laterally-sliding boards.

One embodiment of the present invention is to equalize the downward displacement of each side wheel (and their associated suspension arms) with that of their respective center wheel in a neutral position. In such an instance all 6 wheels are contact the ground. The result is a stable platform when the board is traveling straight, as well as when transitioning from leaning from one side to the other. While the springs in this neutral position exert little to zero downward force to push the wheels toward the ground, they do operate in compression, to absorb irregularities in the surface of the road so that contact between the pavement and the wheels is maintained.

An obvious distinction between snowboarding and riding on a laterally-sliding board is the inherent difference between snow and pavement. Snow is "compliant", in that as a snowboard travels over the snow, the snow, to varying degrees, gives way under the board, and an edge and a certain portion of the board always remain in contact with the snow.

In contrast, pavement does not give way to wheels, thus any pavement "ridges" or surface irregularities result in the wheels' bouncing. As the wheels bounce, contact with the ground is lost and with that loss of contact control is also lost, as is the ability to carve, skid or slide. Keeping the wheels in contact with the ground is thus important to maintaining control and to give the rider confidence in the rider's abilities.

As the rider leans to one side, the suspension arms on the side the rider leans into displace greater than those on the opposite side, if the opposite side's arms displace at all. The springs between the board and the suspension arms dampen out forces caused by surface irregularities on the pavement and drive the wheels back toward the pavement in instances in which the wheels would otherwise skip or bounce.

Another embodiment of the present invention limits downward travel of the downhill side wheels, providing a certain degree of force pushing the side wheels down toward the pavement as a rider leans into a turn, while simultaneously preventing the downhill side wheels from catching the pavement during a slide or skid.

According to one embodiment of the present invention, a cam 212, screw 210, 214, or similar mechanical limiter is independently associated with each suspension arm to limit the downward motion of that arm when its respective side wheel is not in contact with the ground. In a slide or skid, the uphill side wheels as well as the center wheels are in contact with the ground. In a traditional, laterally-sliding board the downhill wheels, being fixed to the same rigid axle as the uphill wheels, are only slightly elevated above the ground, based on the angle of the board relative to the ground. In this traditional configuration, the margin of error (that is, the clearance distance of the downhill side wheels from the pavement) is minimal, because the downhill wheels are forced toward their respective longitudinal ends, and thus closer to the centerline of the board (i.e., closer to the pavement).

With a traditional laterally-sliding board, while during an aggressive "hockey stop" maneuver the downhill wheels are raised above the pavement sufficiently to prevent an mishap, in mild skids or slides the downhill side wheels are always very close to the ground: Virtually any unobserved irregularity in the pavement can have dire consequences. Alleviating this vulnerability, the independent suspension arms of the present invention are not linked to the downhill arms. Recall that in prior designs, as the rider leans to one side (the "lean-side") the lean-side side wheels angle inward, toward the center of the board. As the lean-side side wheels angle inward, the opposing side wheels angle outward, toward their respective longitudinal ends. FIGS. 5 and 6 present side and top views, respectively, of a laterally-sliding board in a leaning configuration, according to one embodiment of the present invention.

Figure 5A:
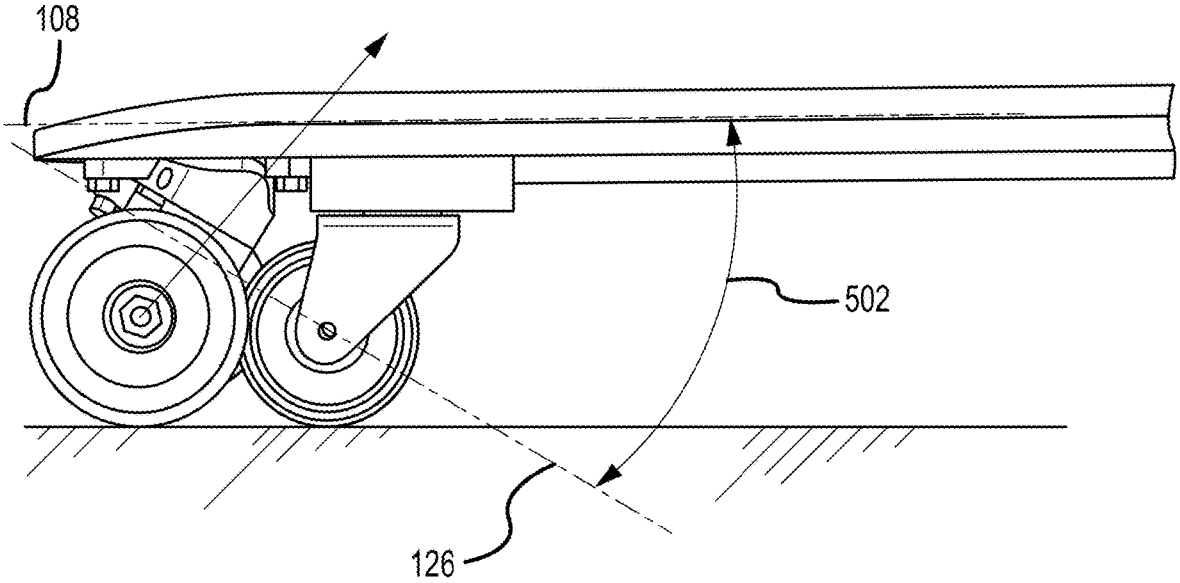
FIGS. 5A and 5B present a side view of a laterally-sliding board in a static (5A) and a leaning (5B) configuration, according to one embodiment of the present invention.
Figure 5B:
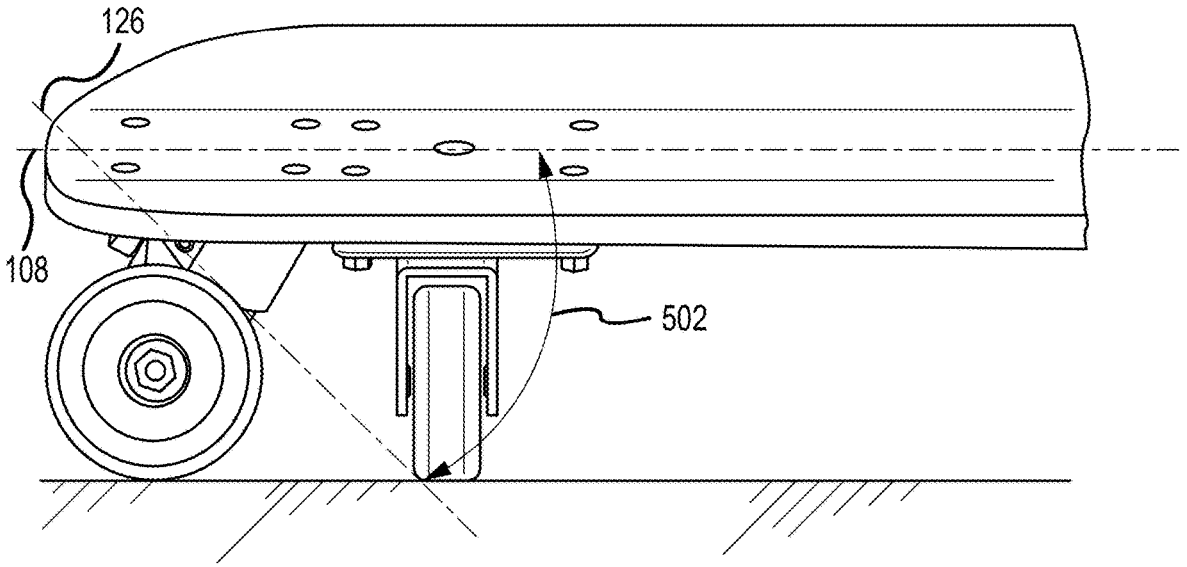
Figure 6:
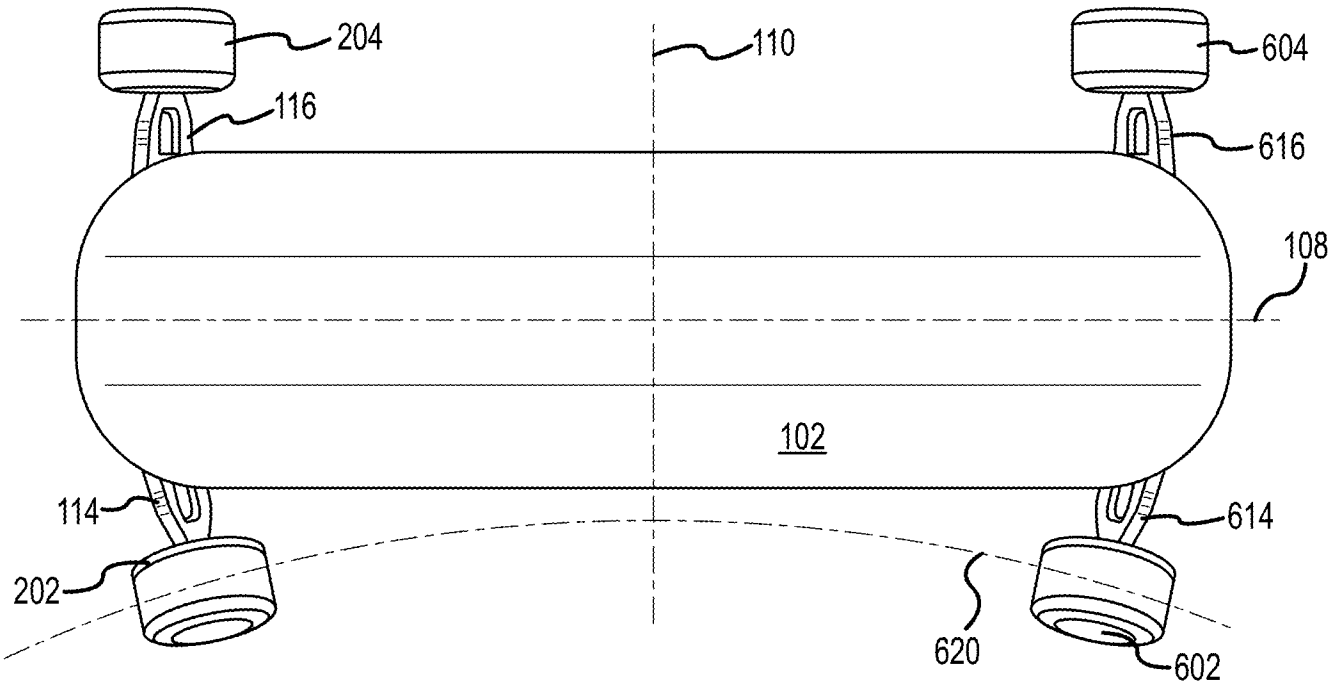
FIG. 6 presents a top view of a laterally-sliding board in a leaning configuration, according to one embodiment of the present invention.

As seen in the side view of FIG. 5A, in a neutral (static) position all three wheels of the forward assembly (the two side wheels and the center wheel) contact the pavement. As one side of the laterally-sliding board of the present invention is depressed, each suspension arm on that side of the board rotates about its respective suspension arm pin through its axis of rotation. As shown in the side view of FIG. 5B, the suspension arm (and thus its associated side-wheel on the lean-side of the board), rotates upward (toward the surface of the board) as well as inward (that is, toward the center of the board). Based on the displacement angle 502, the lean-side side wheels angle inward, creating a "carving edge" to control slides and skids.

FIG. 6 presents a top view of a laterally-sliding board with bifurcated trucks in a leaning configuration, according to one embodiment of the present invention. As the lean-side is depressed, both lean-side suspension arms 114, 614 rotate about their respective axes of rotation, upward and rearward, toward the center of the board. The wheels 202, 602 associated with each suspension arm form an arc 620 defining the radius of the turn.

When carving (that is, turning without skidding), the center wheels align with the radius of the turn and create a stable platform, with four wheels 204, 604 in contact with the ground. Note that the opposing two side wheels are elevated above the ground.

As a slide is initiated, the center wheels caster in the direction of the slide and the uphill "edge" wheels roll in the direction of the slide. The downhill wheels remain elevated substantially and they remain perpendicular to the longitudinal axis of the board, in contrast to traditional boards.

As the uphill suspension arms 114, 614 and associated side wheels 202, 602 are depressed and angle inward, the opposite-side suspension arms 116, 616 at each of the forward and rear wheels 204, 604 are not engaged, remaining in their neutral positions. This, too, is distinctly different from the design of the prior art.

The neutral position of the downhill wheels 204, 604 offers significantly more ground clearance than the outwardly-canted wheels of an integrated wheel truck. This independent-side-wheel design, combined with the lower-limit displacement of each suspension arm, both enhance the safety of the laterally-sliding board. The independent nature of the bifurcated trucks is further illustrated in a front view of the board in a leaning configuration.

Figure 7:
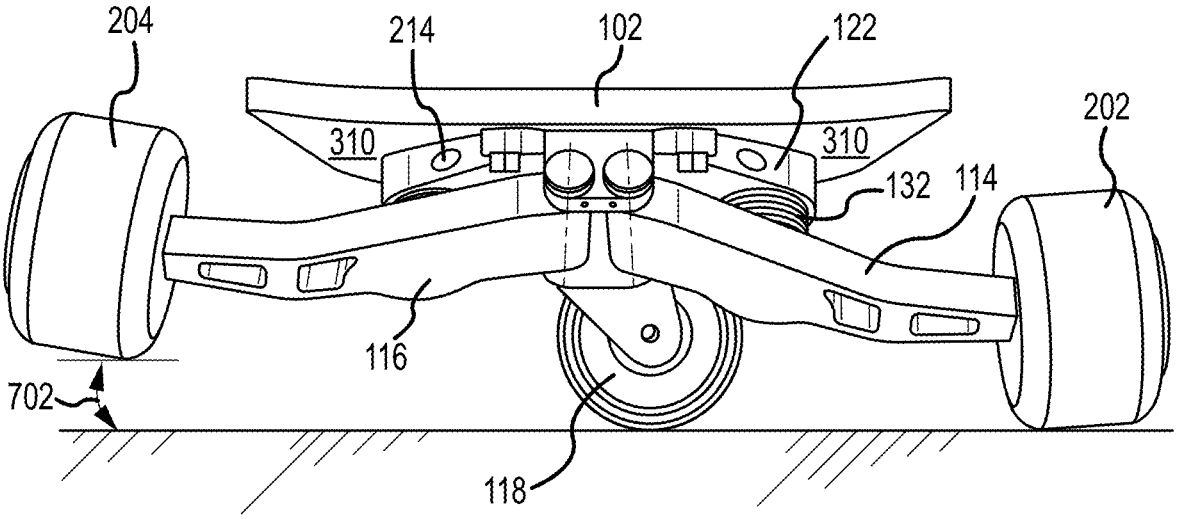
FIG. 7 presents a front view of a laterally-sliding board in a leaning configuration, according to one embodiment of the present invention.

FIG. 7 presents a front view of a sliding board with bifurcated trucks in a leaning configuration, according to one embodiment of the present invention. As the board leans into the hill and the upward suspension arms 114 deflect upward and rearward toward the center of the board, the downhill suspension arms 116 are elevated 702 away from the ground and remain in their original, non-deflected positions. A cam, limit/set screw 210, 214 or similar limiter prevents each downhill suspension arm from dropping below its neutral position, and the independent design allows both arms to remain perpendicular to the longitudinal axis of the board.

Figure 8:
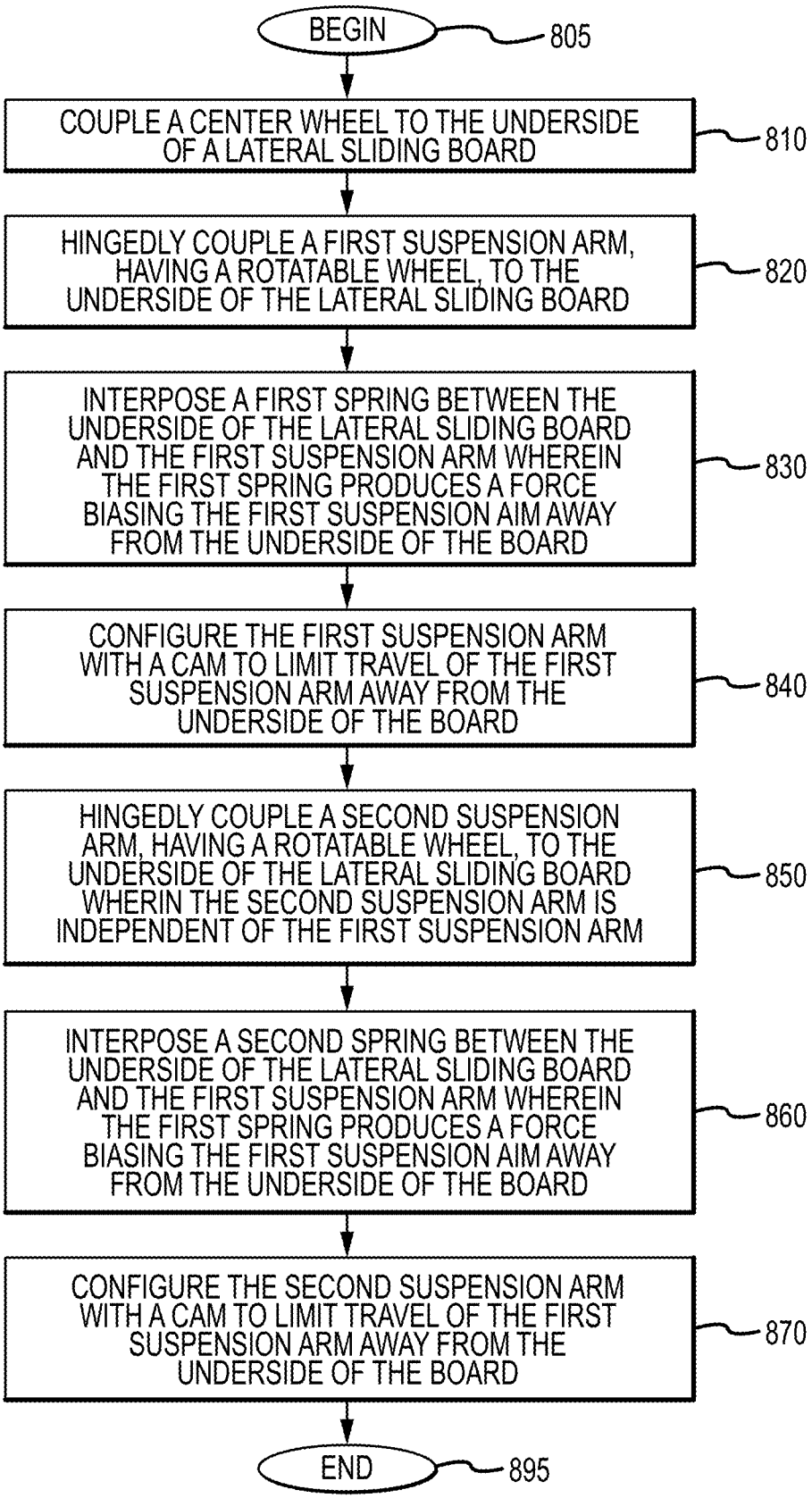
FIG. 8 presents a flowchart of a methodology for forming a laterally-sliding board with bifurcated trucks, according to one embodiment of the present invention.

FIG. 8 is a flowchart of one methodology for forming a laterally-sliding board with a bifurcated truck, according to one embodiment of the present invention. The methodology outlined below describes forming a sliding board with a single wheel assembly, but having independent, bifurcated suspension arms (or "trucks"). One of reasonable skill in the relevant art will appreciate the fact this methodology also applies to the second wheel assembly. Moreover, it should be understood the present disclosure has been made only by way of example—numerous changes in the combinations or arrangements of parts can be resorted to by those skilled in the art without departing from the spirit and scope of the present invention, as hereinafter claimed.

The process begins 805 by coupling 810 a center wheel to the underside of a laterally-sliding board. In one such embodiment, the center wheel is affixed to the board using a mounting bracket, with the wheel free to caster 360 degrees. A first suspension arm is also hingedly coupled 820 to the underside of the board and rotates about a first axis of rotation. In one embodiment, the center wheel and the first suspension arm may be coupled to the underside of the board via the same mounting bracket; in other embodiments each component may be coupled to the board independently.

The construction of the present invention further includes placing a spring between 830 (interposed) the underside of the board and the first suspension arm. The spring acts to produce a force which biases the respective suspension arm away from the underside of the board. The first suspension arm is further configured 840 with a cam, or similar device, which limits the travel of the first suspension arm away from the underside of the board, thus ensuring pavement clearance.

A second suspension arm, which is independent of the first suspension arm as well as the center wheel, is similarly hingedly coupled 850 to the underside of the board and another spring is placed 860 between this second suspension arm and the underside of the board. As with the first suspension arm, the second suspension arm is configured 870 with a cam or similar limiting device, which limits arm travel as discussed immediately above, completing 895 the formation.

An additional feature of the present invention is the independent application of power to the wheels. In one embodiment of the present invention each of the side wheels is independently powered and controlled using a hub motor. In another embodiment the center wheels can also be similarly powered by a hub motor resulting in all six wheels being independently powered and independently controlled or the center wheels alone can be independently powered. A powered laterally-sliding freeboard would include a hub motor at each wheel that is coupled to a controller and a source of power such as a battery. The controller and the battery can be positioned centrally on the underside of the board with electrical connectivity established to each wheel. Lastly a remote control of some sort to communicate with the controller and software to manage the drives systems can provide power to each wheel independently. Current boards require a hill, gravity, as a power source. A powered laterally-sliding board in which the drive system of each wheel is independently driven provides the ability to learn, practice and master techniques on flat horizontal pavement. Moreover, the powered system can augment the board in which the degree of slope varies to maintain constant speed, handling characteristics and other qualities that, up to now, have been limited by finding the right riding environment.

With its novel independent suspension system, the present invention provides substantial improvements over prior-art designs. For example, each suspension truck and each center wheel is independently coupled to the board. The result is a stable, responsive board which overcomes many prior-art limitations. The present configuration allows for a much smoother transition from one edge to another by eliminating the "rocker" effect, as well as introducing dedicated springs—positioned between each suspension arm and the underside of the board—which allow the characteristics of the board to be customized. Moreover, these springs keep the side wheels in constant contact with the ground, as the board travels over varying topographies.

While the invention has been particularly shown and described with reference to embodiments, it will be understood by those skilled in the art that various other changes in the form and details may be made without departing from the spirit and scope of the invention. It must be clearly understood that the foregoing description is only an example—not a limitation—to the scope of the invention. More specifically, the teachings of the foregoing disclosure will suggest other modifications to those skilled in the relevant art. Such modifications may involve other features already known as such, which may be used instead of (or in addition to) features already described in this application. Although claims have been formulated in this application to particular combinations of features, it should be understood that the scope of this disclosure also includes any novel feature or any novel combination of features disclosed either explicitly or implicitly, as well as any generalization or modification which would be apparent to anyone skilled in the relevant art, whether or not these features relate to this invention in any claim and whether or not any of these mitigates any or all of the same technical problems as confronted by this invention. Applicant reserves the right to formulate new claims to any features or combinations of features during the prosecution of this application or of any further application derived from this application.

I claim:

1. A laterally-sliding board, comprising:

a board, wherein the board includes an upper surface, a lower surface, and a longitudinal axis;

a center wheel coupled to the lower surface of the board substantially along the longitudinal axis, wherein the center wheel casters; and a first suspension arm having a first wheel and a second suspension arm having a second wheel wherein each suspension arm is pivotally coupled to the lower surface of the board proximal to the center wheel and wherein the first wheel, second wheel and the center wheel and each suspension arm operate independently and are configured to concurrently contact a ground surface responsive to the board being substantially parallel to the ground surface.

2. The lateral-sliding board of claim 1, wherein the first suspension arm and the second suspension arm include, respectively a first device and a second device, and wherein each the first device and the second device independently limit extension of the first suspension arm and the second suspension arm away from the lower surface of the board.

3. The lateral-sliding board of claim 2, wherein the first device and the second device are, respectively, a first cam and a second cam.

4. The lateral-sliding board of claim 1, wherein the first suspension arm includes a spring biasing the first suspension arm away from the lower surface of the board.

5. The lateral-sliding board of claim 1, wherein the pivotal couple of the first suspension arm and the second suspension arm defines, respectively, a first axis of rotation and a second axis of rotation and wherein each the first axis of rotation and second angle of rotation form an acute angle of depression as measured between the longitudinal axis and the first axis of rotation.

6. The lateral-sliding board of claim 1, further comprising a spring interposed between the board and the first suspension arm producing a force biasing rotation of the first suspension arm away from lower surface.

7. The lateral-sliding board of claim 6, wherein the force is a variable force based on displacement of the spring.

8. The lateral-sliding board of claim 6, further comprising a mounting bracket interposed between the lower surface of the board and each of the first suspension arm and the second suspension arm.

9. A method for forming a laterally-sliding board, comprising;

coupling a center wheel to lower surface of the laterally-sliding board wherein the center wheel casters;

pivotally coupling a first suspension arm having a first wheel and a second suspension arm having a second wheel to the lower surface of the laterally-sliding board proximal to the center wheel; and configuring the first wheel, second wheel, the center wheel and each suspension arm to operate independently and to concurrently contact a ground surface responsive to the laterally-sliding board being substantially parallel to the ground surface.

10. The method for forming a laterally-sliding board of claim 9, wherein the first suspension arm and the second suspension arm pivot about, respectively, a first axis of rotation and a second axis of rotation, and wherein coupling includes forming an acute angle of depression as measured between each the longitudinal axis and the first axis of rotation and second angle of rotation.

11. The method for forming a laterally-sliding board of claim 9, further comprising associating a first limiting device with the first suspension arm wherein the first limiting device limits rotation of the first suspension arm about the first axis of rotation away from the lower surface of the board.

12. The method for forming a laterally-sliding board of claim 11, further comprising associating a second limiting device with the second suspension arm wherein the second limiting device limits rotation of the second suspension arm about the second axis of rotation away from the lower surface of the board, the first limiting device operating independent of the second limiting device.

13. The method for forming a laterally-sliding board of claim 9, further comprising interposing a spring between the first suspension arm and the lower surface of the board.

14. The method for forming a laterally-sliding board of claim 9, further comprising biasing the first suspension arm away from the lower surface of the board.

15. The method for forming a laterally-sliding board of claim 9, interposing a mounting bracket between the lower surface of the board and the first suspension arm and the second suspension arm.

* * * * *